US009276357B2

(12) United States Patent
Hutchison et al.

(10) Patent No.: US 9,276,357 B2
(45) Date of Patent: Mar. 1, 2016

(54) APPARATUS FOR RETAINING A PLUG IN A RECEPTACLE

(71) Applicant: PCE, Inc., Lincoln, NE (US)

(72) Inventors: Gordon Hutchison, Lincoln, NE (US); Jesse Preuss, Lincoln, NE (US); Duncan Shea-Simonds, Lincoln, NE (US)

(73) Assignee: PCE, Inc., Lincoln, NE (US)

( * ) Notice: Subject to any disclaimer, the term of this patent is extended or adjusted under 35 U.S.C. 154(b) by 0 days.

(21) Appl. No.: 14/485,154

(22) Filed: Sep. 12, 2014

(65) Prior Publication Data

US 2015/0104968 A1 Apr. 16, 2015

Related U.S. Application Data

(60) Provisional application No. 61/877,105, filed on Sep. 12, 2013.

(51) Int. Cl.

| | |
|---|---|
| ***H01R 13/629*** | (2006.01) |
| ***H01R 13/639*** | (2006.01) |
| ***H01R 24/78*** | (2011.01) |
| *H01R 103/00* | (2006.01) |

(52) U.S. Cl.

CPC ..... *H01R 13/629* (2013.01); *H01R 13/639* (2013.01); *H01R 24/78* (2013.01); *H01R 2103/00* (2013.01)

(58) Field of Classification Search

CPC ..... H01R 13/6395; H01R 13/447

See application file for complete search history.

(56) References Cited

U.S. PATENT DOCUMENTS

| | | | | |
|---|---|---|---|---|
| 4,618,200 | A * | 10/1986 | Roberts | H01R 13/6395 439/147 |
| 4,917,625 | A | 4/1990 | Haile | |
| 6,443,762 | B1 * | 9/2002 | Lessig, III | H01R 13/639 439/373 |
| 6,769,930 | B1 * | 8/2004 | McDevitt, Jr. | H01R 13/6395 439/373 |
| 6,939,161 | B1 * | 9/2005 | Yi | H01R 13/6395 439/373 |
| 7,014,493 | B1 * | 3/2006 | Battard | H01R 13/6395 439/371 |
| 7,559,788 | B2 * | 7/2009 | Legg | H01R 13/6395 439/371 |
| 7,722,380 | B1 * | 5/2010 | West | H01R 13/6395 439/373 |
| 8,052,437 | B2 | 11/2011 | Jiang et al. | |
| 8,956,177 | B2 * | 2/2015 | Warner | H01R 13/6395 439/373 |
| 2006/0264087 | A1 | 11/2006 | Woellner et al. | |
| 2007/0032115 | A1 | 2/2007 | Takashita | |
| 2011/0237108 | A1 | 9/2011 | Vass | |
| 2012/0015541 | A1 | 1/2012 | Lu | |

FOREIGN PATENT DOCUMENTS

| | | |
|---|---|---|
| WO | 2013036966 A2 | 3/2013 |

OTHER PUBLICATIONS

Tripp Lite PDU Plug Lock Connector C14 Power Cord to C13 Outlet Red 100PK, Mfg. Part: PLC13RD, CDW Part: 3070678, Printed online at: www.cdw.com.

C14SecureSleeve Contact Retention Insert for connecting a C14 into a C13 Yellow, Item #: 6820, Printed online at: www.stayonline.com.

* cited by examiner

*Primary Examiner* — Gary Paumen

(74) *Attorney, Agent, or Firm* — Suiter Swantz pc llo

(57) ABSTRACT

The present disclosure is an apparatus for retaining a plug within a receptacle. The apparatus for retaining a plug within a receptacle may include a receptacle body and a retention device. The retention device may include a face portion and at least one prong, each prong of the at least one prong including a barb. The retention device is configured to retain a plug inserted within the receptacle body by contact with a shroud of the plug from the barb of each prong of the at least one prong of the retention device.

22 Claims, 10 Drawing Sheets

APPARATUS FOR RETAINING A PLUG IN A RECEPTACLE

CROSS REFERENCE TO RELATED APPLICATIONS

The present application claims the benefit under 35 U.S.C. §119 of U.S. Provisional Patent Application Ser. No. 61/877,105 filed Sep. 12, 2013. The U.S. Provisional Patent Application Ser. No. 61/877,105 filed Sep. 12, 2013 is hereby incorporated by reference in its entirety.

TECHNICAL FIELD

The present disclosure generally relates to the field of computing cables and power cables, and more particularly to an apparatus for retaining a plug in a receptacle.

BACKGROUND

Many electronic devices, particularly computer and data storage equipment, are supplied power from an alternating current (AC) power source. The power is supplied from a power cord connected to the AC power source. A typical power cord may include a cable, the cable including a plug to connect to the AC power source and a second connector to connect to an electronic device. It is critical for the operation of the electronic device that it receives power, particularly for data storage equipment. A problem with the effective operation of the electronic device is the inadvertent or unintentional disconnection of the plug of the power cord from a receptacle of the AC power source, thus preventing a supply of power to the electronic device.

SUMMARY

Accordingly, the present disclosure is directed to an apparatus for retaining a plug within a receptacle. The apparatus for retaining a plug within a receptacle may include a receptacle body and a retention device. The retention device may include a face portion and at least one prong, each prong of the at least one prong may include at least one barb. The retention device is configured to retain a plug inserted within the receptacle body by contact with a shroud of the plug from the barb of each prong of the at least one prong of the retention device.

It is to be understood that both the foregoing general description and the following detailed description are exemplary and explanatory only and are not necessarily restrictive of the present disclosure. The accompanying drawings, which are incorporated in and constitute a part of the specification, illustrate subject matter of the disclosure. Together, the descriptions and the drawings serve to explain the principles of the disclosure.

BRIEF DESCRIPTION OF THE DRAWINGS

The numerous advantages of the disclosure may be better understood by those skilled in the art by reference to the accompanying figures in which.

DETAILED DESCRIPTION

Reference will now be made in detail to the subject matter disclosed, which is illustrated in the accompanying drawings.

Referring to FIGS. 1-12, an apparatus for retaining a plug within a receptacle according to various embodiments is shown. The apparatus for retaining a plug within a receptacle may include a receptacle body and a retention device. The retention device may include a face portion and at least one prong, each prong of the at least one prong may include at least one barb. The retention device is configured to retain a plug inserted within the receptacle body by contact with a shroud of the plug from the barb of each prong of the at least one prong of the retention device.

Figure 1:
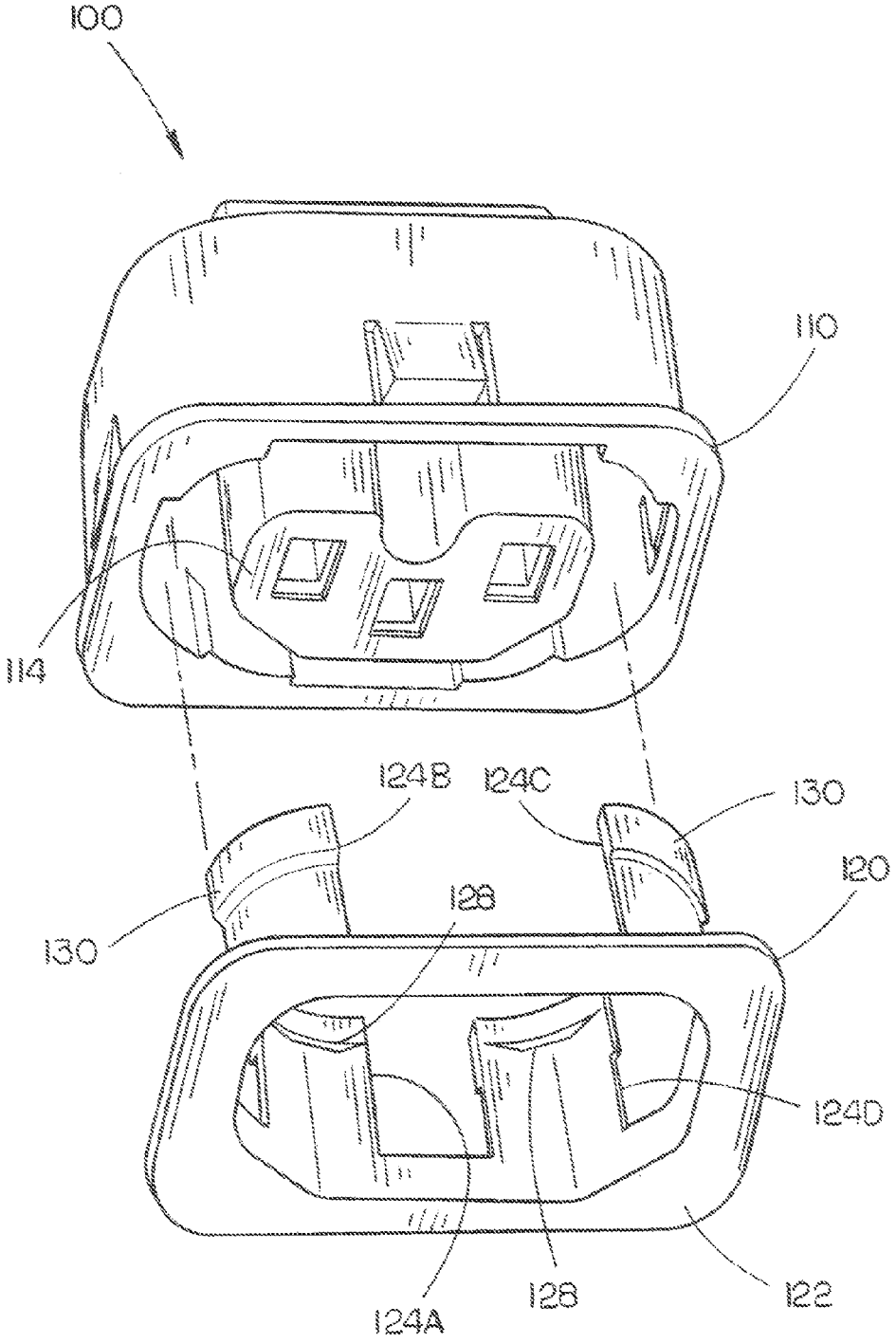
FIG. 1 depicts an apparatus for retaining a plug in a receptacle in accordance with an embodiment of the present disclosure.

Referring specifically to FIG. 1, an apparatus 100 for retaining a plug in a receptacle in accordance with an embodiment of the present disclosure is shown. Apparatus 100 for retaining a plug within a receptacle may include a receptacle body 110 and a retention device 120. Receptacle body 110 may include a receptacle 114. In an alternative embodiment, receptacle body 110 may surround a receptacle 114. Retention device 120 may include a face portion 122 and at least one prong 124A, 124B, 124C and 124D. As shown in FIG. 1, four prongs are included. Each prong 124A-124D may include at least one barb 128 and a ridge 130. It is contemplated that barb 128 may be located on a first side of a prong and ridge 130 may be located on an opposite side of the first side, or a second side of the prong. Retention device 120 is configured to retain a plug inserted within the receptacle body 110 by contact with a shroud of the plug from the barb 128 of each prong 124A-124D of the retention device 120.

As shown in FIG. 1, receptacle 114 may be part of receptacle body. It is contemplated that receptacle 114 may include a female electrical fitting, referred and called a connector as shown and further described in FIG. 10. It should also be understood that receptacle 114 may also include a male electrical fitting, also referred and called an inlet mechanism as shown and further described in FIG. 9.

Receptacle body 110 and retention device 120 may be formed of a variety of rigid materials, including plastic, composites and metals. It is contemplated that plastic may be engineering grade and plastic may be in compliance with local safety requirements. Barb 128 may be formed of plastic in one embodiment of the disclosure. In an alternative embodiment, barb 128 may be formed of metal, such as stainless steel.

Figure 2:
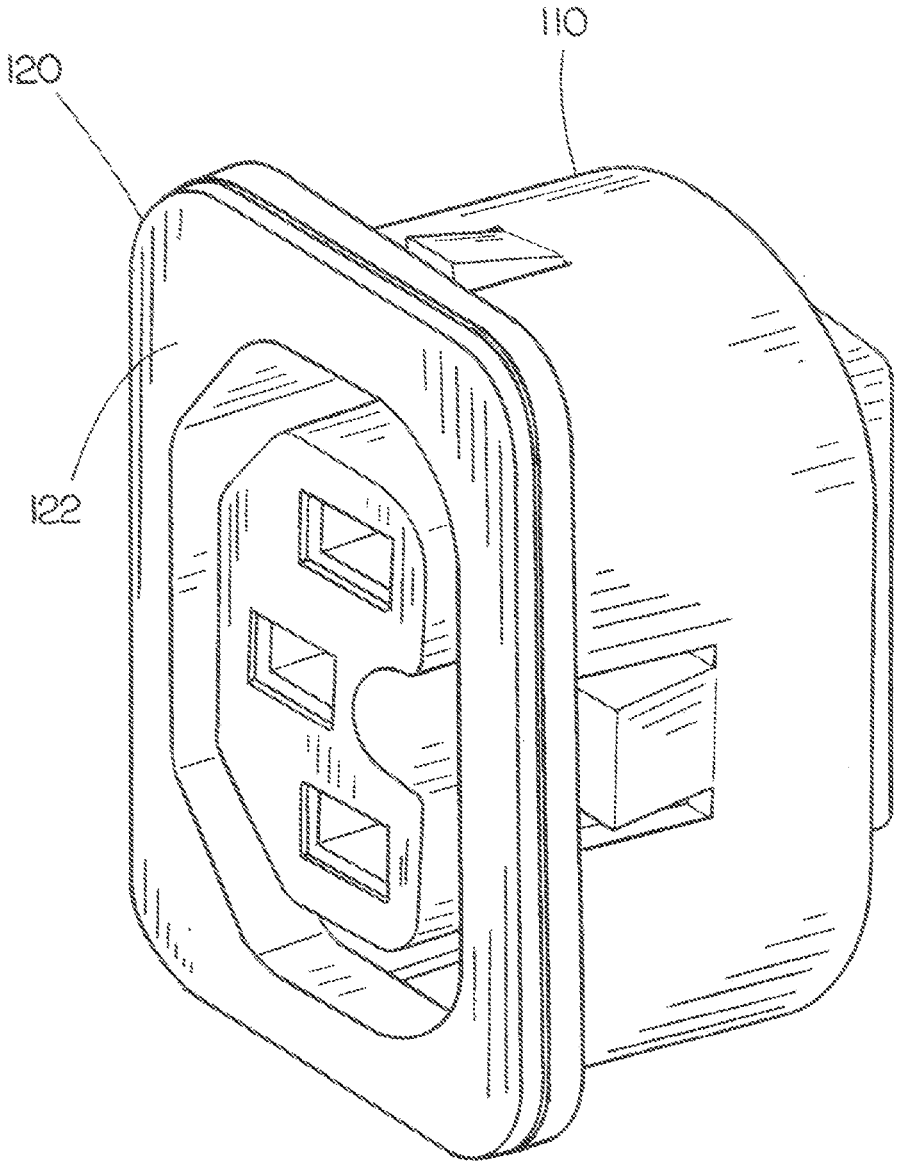
FIG. 2 depicts another view of an apparatus for retaining a plug in a receptacle in accordance with an embodiment of the present disclosure.

Referring to FIG. 2, an apparatus 100 for retaining a plug in a receptacle is shown with retention device 120 inserted within receptacle body 110. It is contemplated that retention device 120 may be inserted within the receptacle body 110 and may retain a plug with a shroud without requiring any modification to the shroud.

Figure 3:
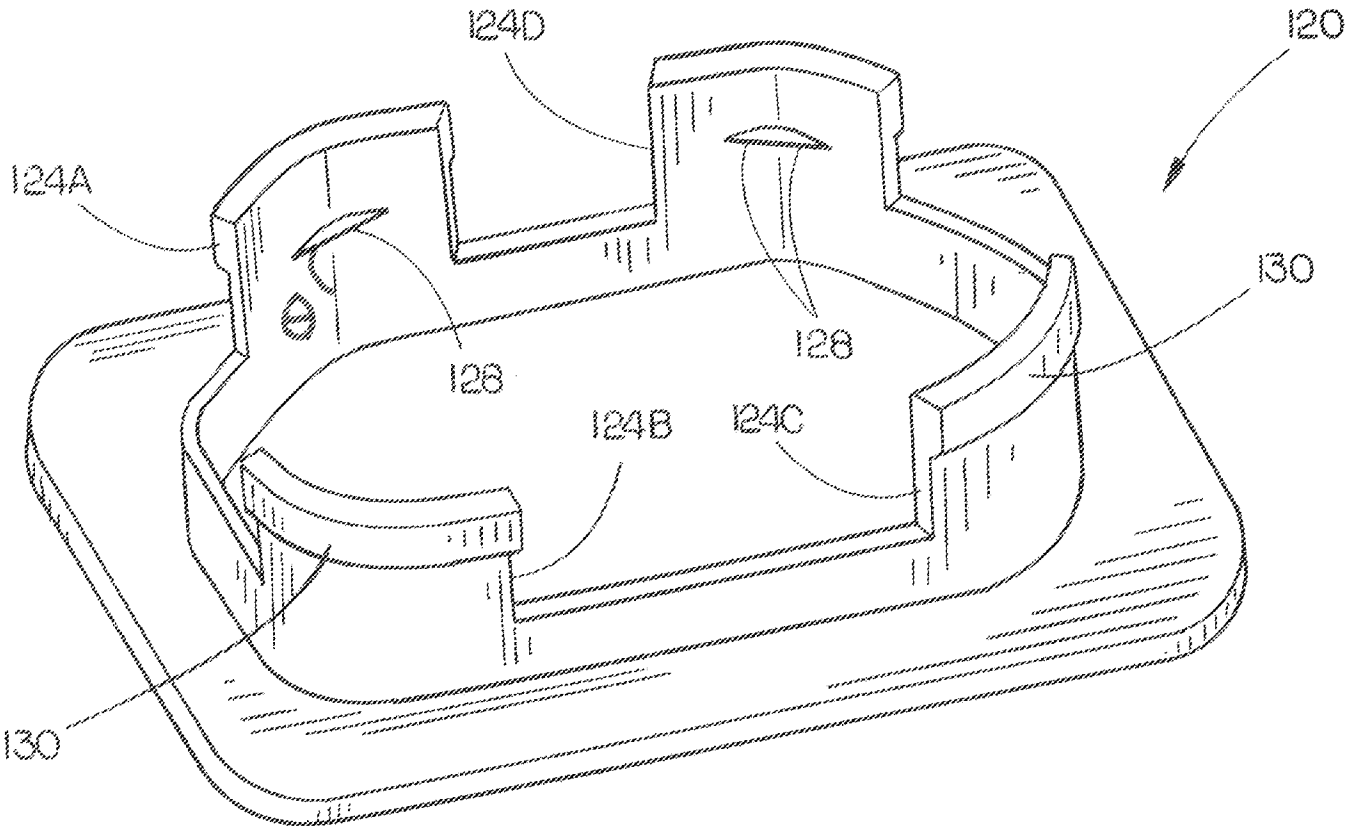
FIG. 3 depicts a retention device in accordance with an embodiment of the present disclosure.
Figure 4:
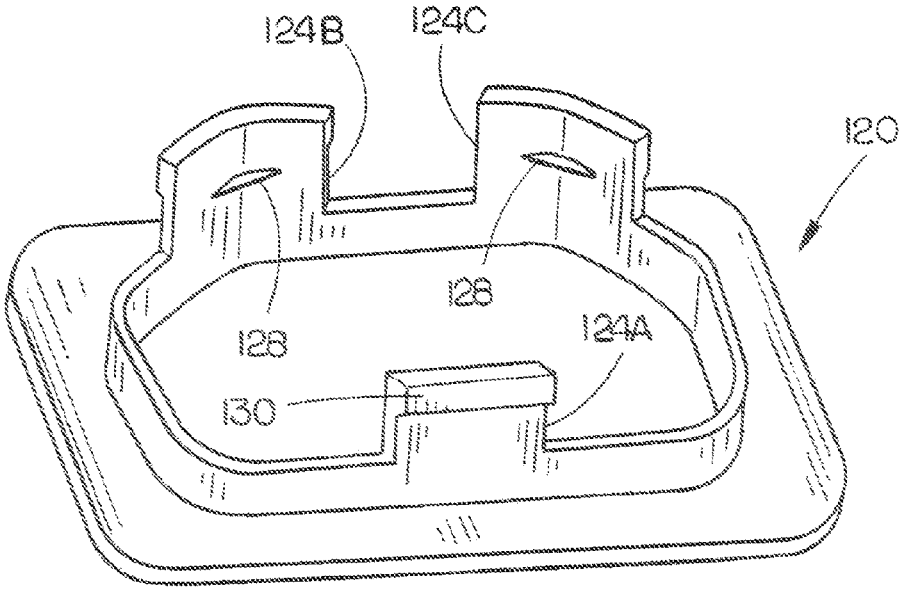
FIG. 4 depicts a retention device in accordance with an alternative embodiment of the present disclosure.
Figure 5:
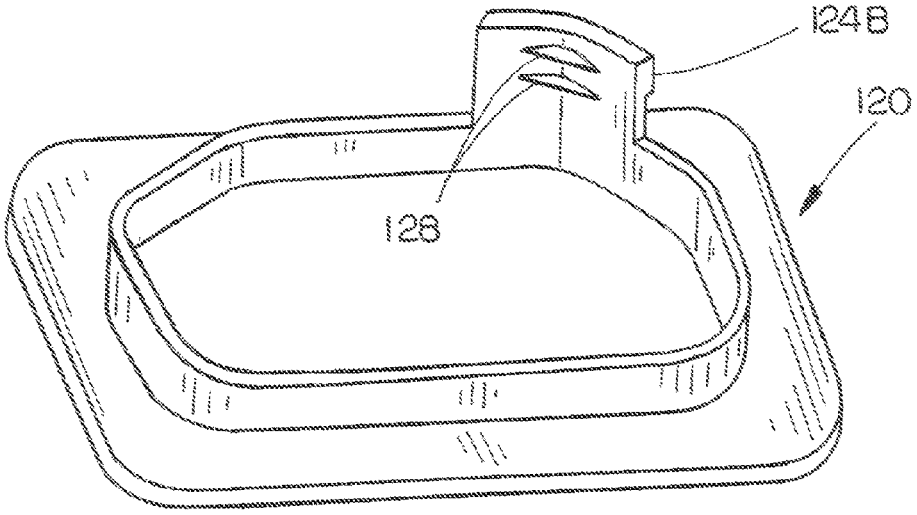
FIG. 5 depicts a retention device in accordance with an additional alternative embodiment of the present disclosure.
Figure 6:
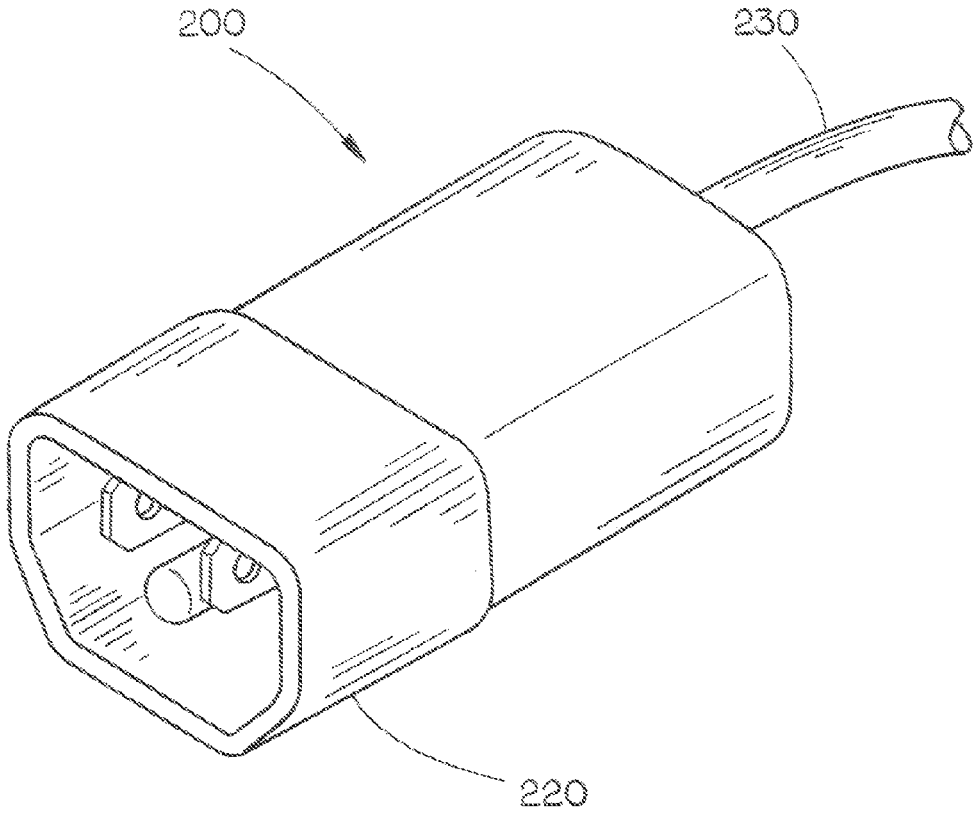
FIG. 6 depicts an exemplary plug which is retained in a retaining apparatus in accordance with an embodiment of the present disclosure.

Referring to FIGS. 3-5, a retention device 120 in accordance with various embodiments of the present disclosure is shown. It is contemplated the retention device 120 may be operable with at least one prong 124B as shown in FIG. 5. In alternative embodiments, retention device 120 may include three prongs (124A-124C) and four prongs (124A-124D) as shown in FIG. 4 and FIG. 3 respectively. Additionally, retention device 120 may include two prongs or may include five or more prongs without departing from the scope and intent of the present disclosure. It is further contemplated that the placement of the at least one prong may be adjusted without departing from the scope and intent of the present disclosure. As shown in FIG. 3, four prongs 124A-124D may be placed to make contact with corners of a shroud 220 of plug 200 as shown in FIG. 6. However, it should be understood that prongs 124A-124D may be placed to make contact with sides of shroud 220 of plug 200 as shown in FIG. 6. Similarly, placement of the at least one prong may be placed in alternate locations to make contact with one or more corners and one or more sides of a shroud 220 of plug 200 as shown in FIG. 6.

Each prong 124A-124D may include at least one barb 128 and a ridge 130. Barb 128 may refer to a projection extending from the prong which is configured to contact a shroud of a plug. It is contemplated that barb 128 may be formed of metal, such as stainless steel, and may project from the prong which may be formed of plastic. It is contemplated that barb 128 may project from the prong at a desired angle in order to enhance the retention of the plug. As shown in FIG. 3, in one embodiment, each barb extends from each prong at an angle, Θ, of about 120-150 degrees from the prong as the prong extends from the face portion 122 of the retention device 120. The desired angle of about 120-150 degrees from device 120.

Referring to FIG. 6, an exemplary plug 200 which the prong as the prong extends from the face portion 122 of the retention device 120 may apply to one or more barbs of one or more prongs of the retention is retained in the retaining apparatus in accordance with an embodiment of the present disclosure is shown. Plug 200 may include a male electrical fitting for making an electrical connection with a corresponding female fitting, such as receptacle 114. It is contemplated that plug 200 may be electrically coupled with cable 230. Plug 200 may include a shroud 220. In an alternative embodiment, plug 200 may include a female electrical fitting for making an electrical connection with a corresponding male fitting, such as an inlet mechanism as shown and described in FIG. 9 and a connector as shown and described in FIG. 10.

Figure 7:
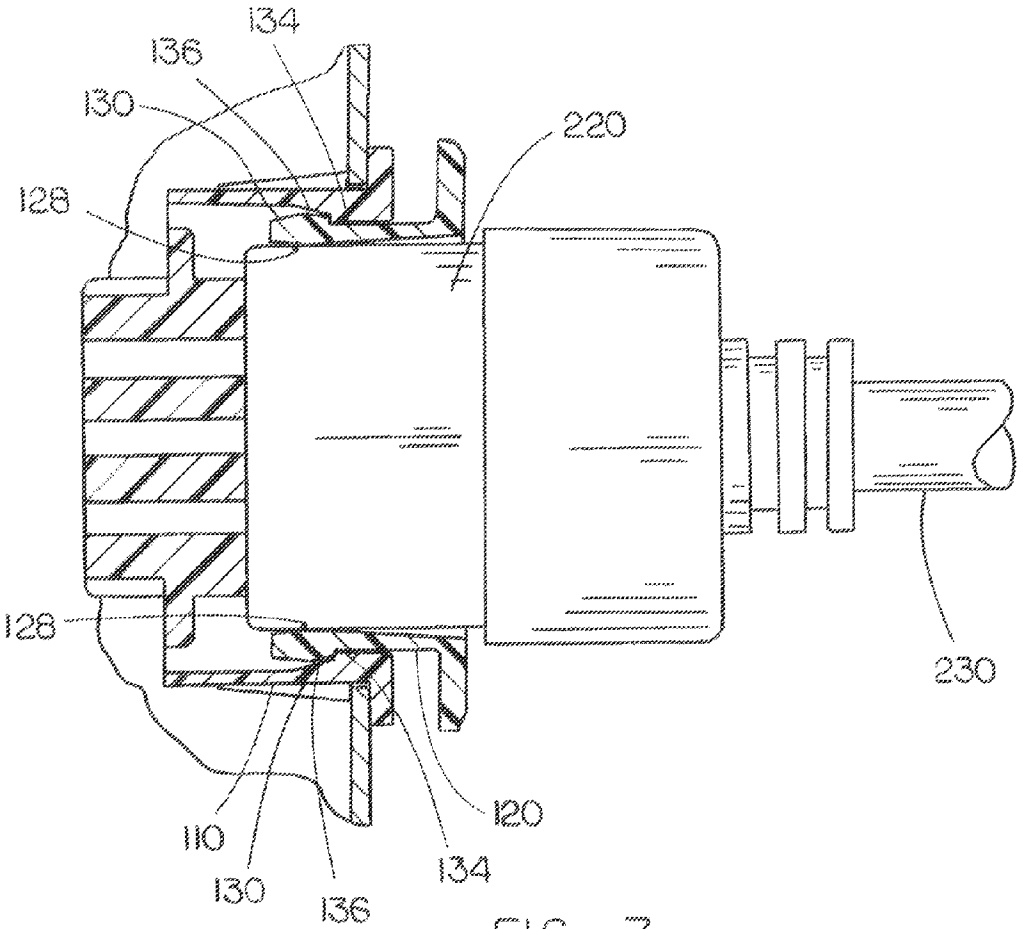
FIG. 7 depicts a cutaway view of the apparatus for retaining a plug in a receptacle in a retention position in accordance with an embodiment of the present disclosure.
Figure 8:
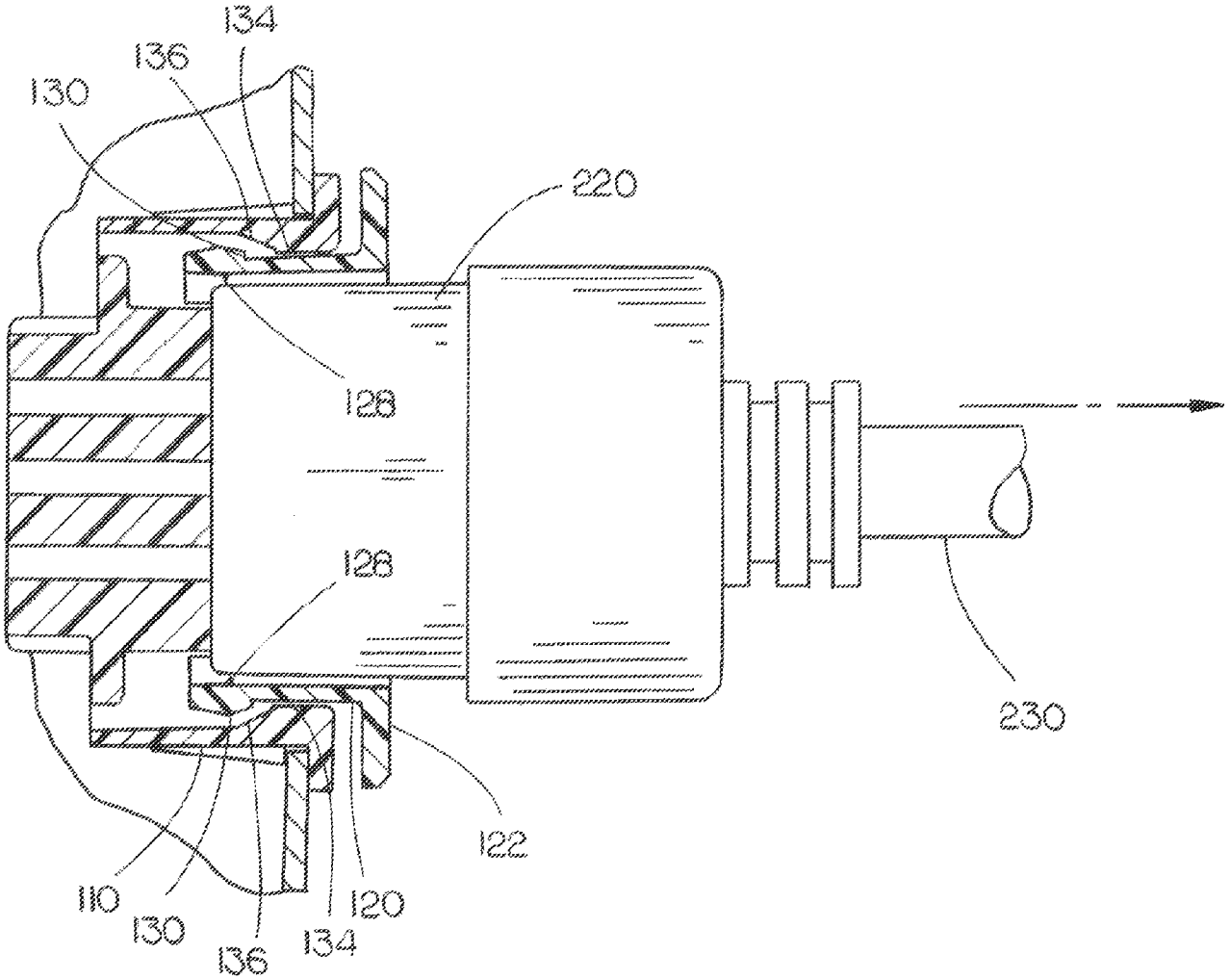
FIG. 8 depicts a cutaway view of the apparatus for retaining a plug in a receptacle in a release position in accordance with an embodiment of the present disclosure.

Referring to FIG. 7 and FIG. 8, cutaway views of the apparatus for retaining a plug are shown. FIG. 7 depicts a cutaway view of the apparatus for retaining a plug in a receptacle in a retention position in accordance with an embodiment of the present disclosure. FIG. 8 depicts a cutaway view of the apparatus for retaining a plug in a receptacle in a release position in accordance with an embodiment of the present disclosure.

As shown in FIG. 7, barb 128 of each prong of a plurality of prongs contact shroud 220. Each prong is forced toward the shroud 220 by contact from a second side or exterior side of the prong by tapered wall portion 136 of the receptacle body 110. As can be seen, the tapered wall portion 136 puts more force on each prong as the plug is pulled from the receptacle body 120 while still remaining in electrical contact with the receptacle. The tapered wall portion 136, or ramp, reduces the space in the receptacle body as the plug is removed from the body. This causes more force to be applied to each prong of the retention device and causes each barb of each prong to make contact with the shroud. The plug may be jammed between the prongs of the retention device and retained within the receptacle body, also referred as an interference fit or contact fit.

Receptacle body 110 further includes a ledge 134 configured to prevent removal of retention device 120 from the receptacle body 110 by contacting ridge 130 of each prong of the retention device 120. When plug 200 should be removed from apparatus for retaining the plug, face portion 122 of retention device 120 is forced inward toward the receptacle body 110. By forcing the retention device 120 toward the receptacle body 110, the jam caused by the prongs of the retention device 120 may be released. As the retention device 120 is forced toward the receptacle body 110, the space within the receptacle body expands as tapered wall portion 136 of the receptacle body 110 may be tapered toward the interior of the receptacle body 110. When this occurs, there is less force applied to each prong by the tapered wall portion 136 of receptacle body 110. As a result, each barb 128 of each prong of the retention device 120 releases the shroud 220 of the plug 200.

Figure 9:
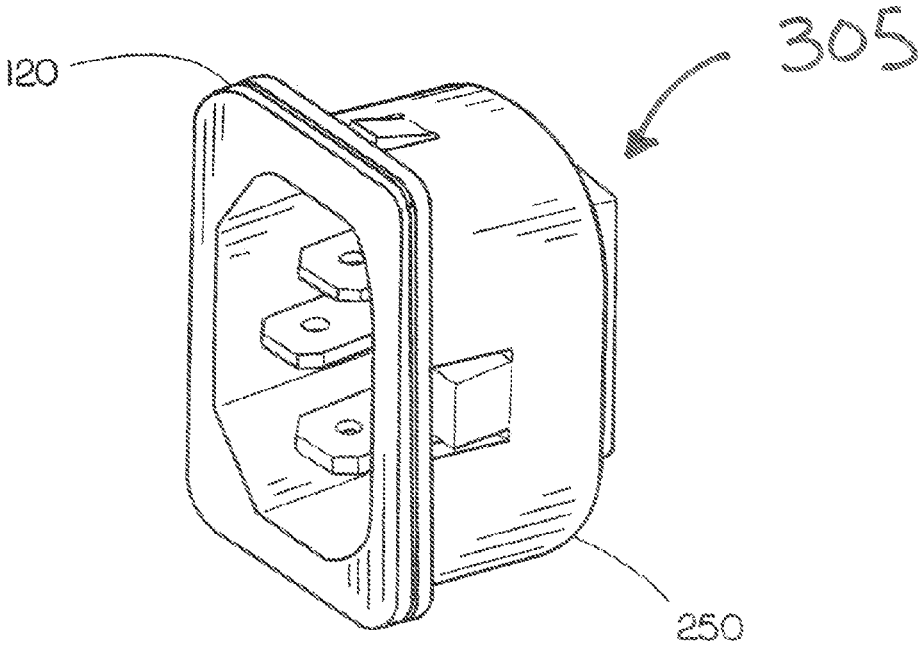
FIG. 9 depicts an apparatus for retaining a connector in an inlet mechanism in accordance with an embodiment of the present disclosure.
Figure 10:
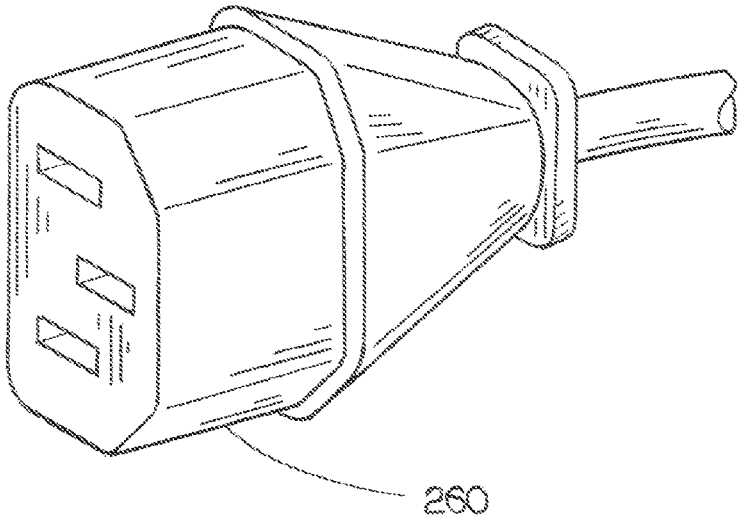
FIG. 10 depicts an exemplary connector which is retained in a retaining apparatus in accordance with an embodiment of the present disclosure.

Referring to FIG. 9 and FIG. 10, an apparatus 305 for retaining a connector 260 in an inlet mechanism 250 in accordance with an embodiment of the present disclosure is shown. Inlet mechanism 250 may include a male electrical fitting and may be similar as receptacle 110 but may include the male pins. Retention device 120 may operate with inlet mechanism 250 to retain a corresponding female electrical fitting such as connector 260 as shown in FIG. 10. It is contemplated that a barb of at least one prong of retention device 120 may contact and retain a shroud of connector 260. In an embodiment, retention device 120 and inlet mechanism 250 may include a retention position and release position as described and shown in FIG. 7 and FIG. 8 with respect to a receptacle body 110.

Figure 11:
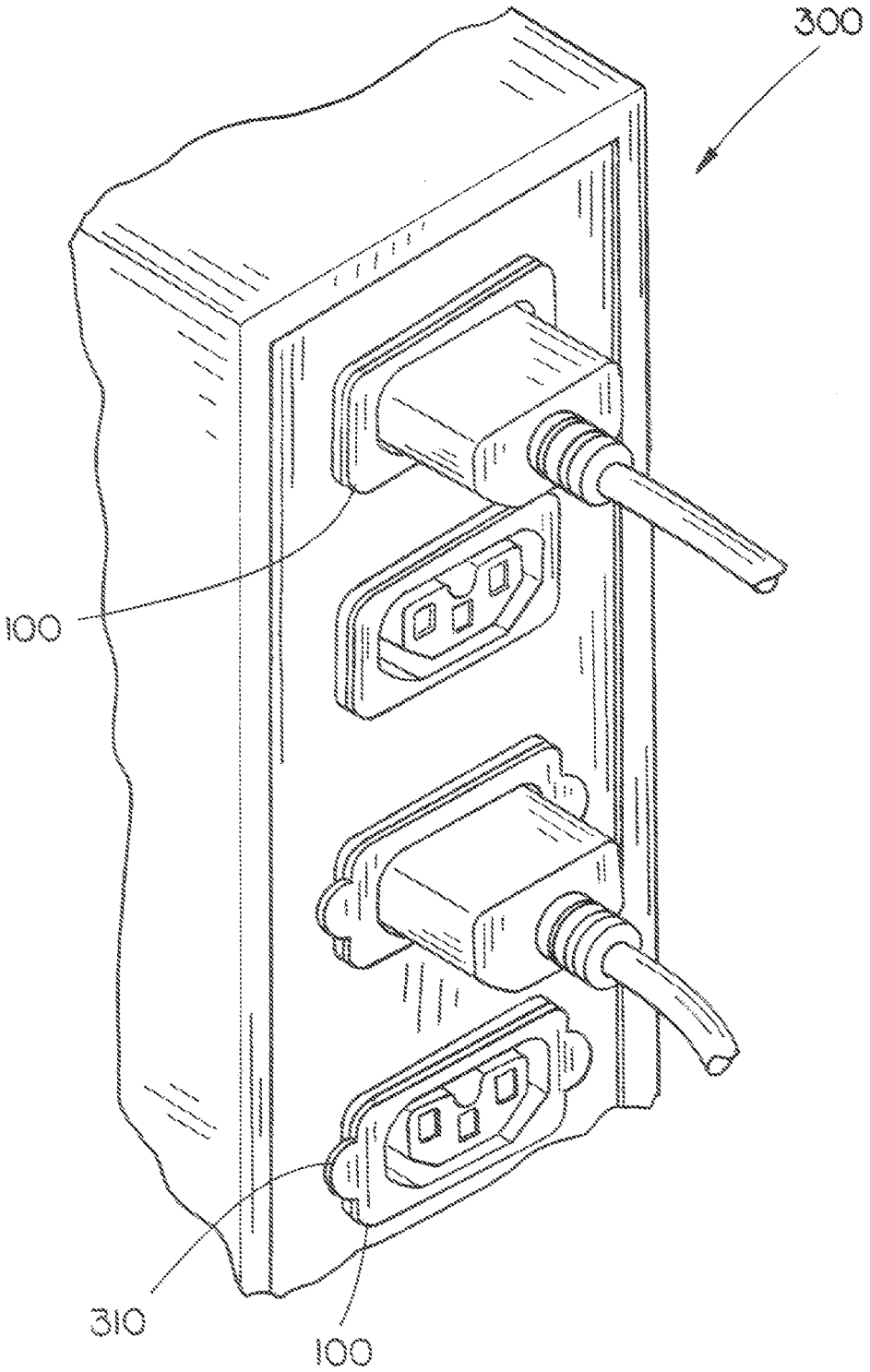
FIG. 11 depicts a power strip including an apparatus for retaining a plug in a receptacle in accordance with an embodiment of the present disclosure.

Referring to FIG. 11, a power strip 300 including an apparatus for retaining a plug in a receptacle in accordance with an embodiment of the present disclosure is shown. Power strip 300 may include a plurality of receptacles 114 which supply power to a plurality of electronic devices. It is contemplated that multiple apparatuses 100 for retaining a plug may be employed in a power strip 300 to prevent unintended disconnection of a plug from a receptacle. It is contemplated that face portion of retention device 120 may include one or more tabs 310. One or more tabs 310 may allow easier finger access to the retention device to allow the retention device to be forced toward the receptacle body to allow removal of a plug.

Figure 12:
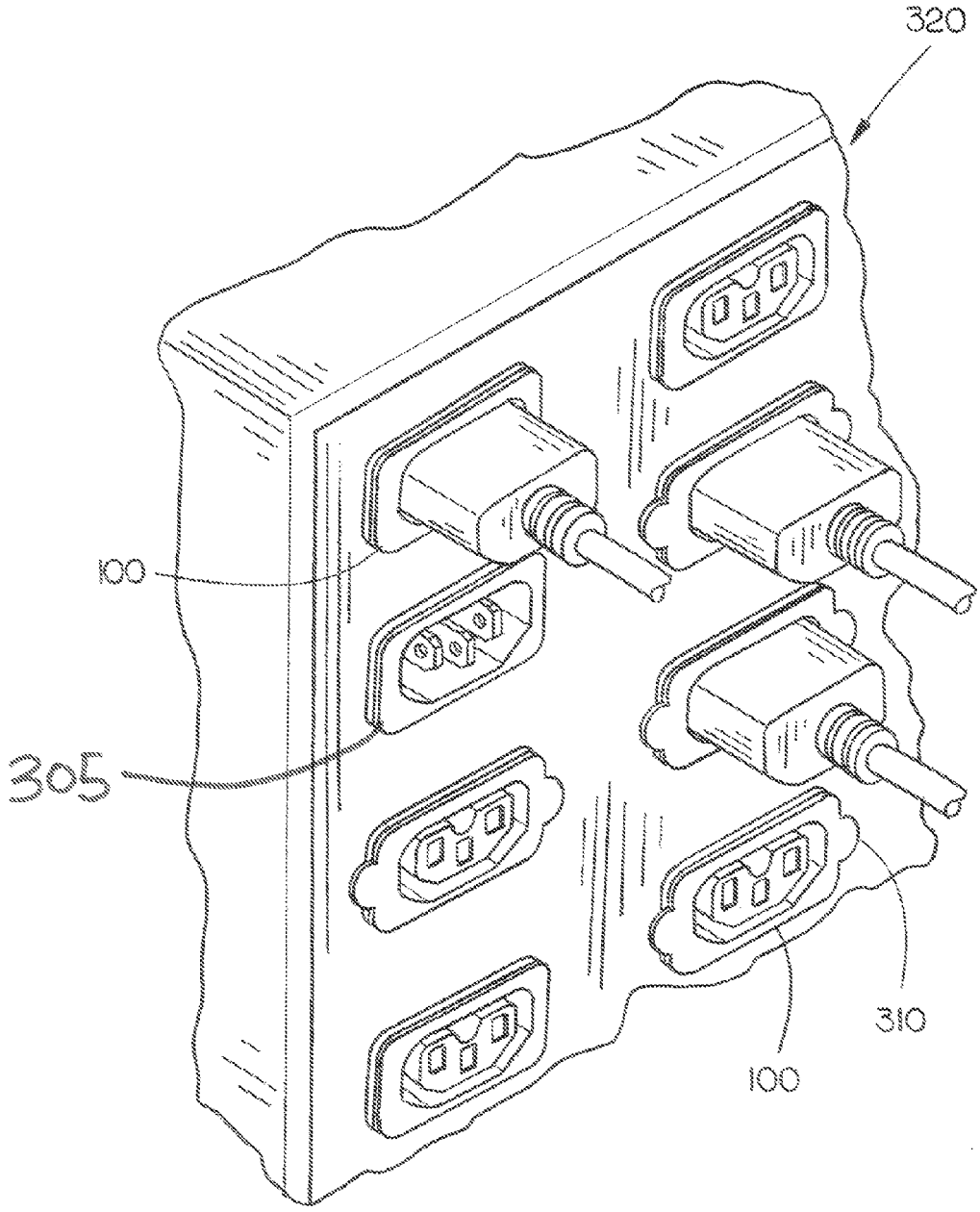
FIG. 12 depicts a power strip including an apparatus for retaining a plug in a receptacle and an apparatus for retaining a connector in an inlet mechanism in accordance with an embodiment of the present disclosure.

Referring to FIG. 12, a power strip 320 may include an apparatus 100 for retaining a plug in a receptacle and an apparatus 305 for retaining a connector in an inlet mechanism in accordance with an embodiment of the present disclosure is shown. It is contemplated that multiple apparatuses 100, 305 may be employed in a power strip 320 to prevent unintended disconnection of a plug or connector. It is contemplated that face portion of retention device 120 may include one or more tabs 310. One or more tabs 310 may allow easier finger access to the retention device to allow the retention device to be forced toward the receptacle body to allow removal of a plug.

It is contemplated that apparatus 100, 305 may provide a number of advantages over locking receptacles known to the conventional art. Conventional locking receptacles may include specialized receptacles or specialized plugs. Specialized receptacles and specialized plugs create additional costs and reduce the flexibility to change power cords in a large scale electrical power distribution system, such as power strips employed in a data center providing power to multiple data servers. Advantageously, apparatus 100, 305 may be operable with power cords supplied by the manufacturers of electronic equipment, such as data servers.

It is contemplated that apparatus 100, 305 may be operable with IEC 60320 couplers, referring to a list of standards from the International Electrotechnical Commission specifying non-locking appliance couplers and interconnection couplers for the connection of power supply cords to electrical appliances up to 250 Volts, including C13, C15, C19 and C21 receptacles. Additionally, it is contemplated that apparatus 100 may be operable with any type of plug that includes a shroud that may cover at least a portion of the pins of the plug. Also, the apparatus 305 may be operable with a female coupler with any type of shroud.

An additional advantage of the apparatus 100, 305 may include the ability to employ labels and different colors. By adding an identifier such as color or a label to the face portion 122 of the retention device 120, particular receptacles may be more easily identified and separated, particularly when implemented with a power strip 300, 320 as depicted in FIG. 11 and FIG. 12.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes.

What is claimed is:

1. An apparatus for retaining a plug within a receptacle;

a receptacle body; and a retention device, the retention device including a face portion and at least one prong, each prong of the at least one prong including at least one barb, wherein the retention device is configured to retain a plug within said receptacle body by contact with a shroud of the plug from the at least one barb of each prong of said at least one prong of the retention device, each prong of said at least one prong of the retention device includes a ridge located on an opposite side of the at least one barb, the receptacle body includes a ledge configured to contact the ridge of each prong and prevent removal of the retention device from the receptacle body.

2. The apparatus as claimed in claim 1, wherein the receptacle body includes a receptacle.

3. The apparatus as claimed in claim 2, wherein said receptacle includes a female electrical fitting.

4. The apparatus as claimed in claim 3, wherein said plug includes a male electrical fitting.

5. The apparatus as claimed in claim 2, wherein said receptacle includes a male electrical fitting.

6. The apparatus as claimed in claim 5, wherein said plug includes a female electrical fitting.

7. The apparatus as claimed in claim 1, wherein the receptacle body includes a tapered interior wall which contacts the at least one prong of the retention device and forces the at least one prong toward the shroud of the plug.

8. The apparatus as claimed in claim 1, wherein the at least one barb of each prong of the retention device is configured to release the shroud of the plug when said face portion of the retention device is forced toward the receptacle body.

9. The apparatus as claimed in claim 1, wherein said retention device includes at least four prongs.

10. The apparatus as claimed in claim 1, wherein each barb extends from each prong at an angle of about 120-150 degrees from the prong as the prong extends from the face portion of the retention device.

11. An apparatus for retaining a plug within a receptacle;

a receptacle body, the receptacle body comprising a receptacle, the receptacle including a female electrical fitting; and a retention device, the retention device including a face portion and at least four prongs, each prong of the at least four prongs including a barb on a first side of the prong and a ridge on a second side of the prong, wherein the retention device is configured to retain a plug inserted within the receptacle body by contact with a shroud of the plug from the barb of each prong of said at least four prongs of the retention device, wherein the barb includes metal.

12. The apparatus as claimed in claim 11, wherein the face portion and at least four prongs of the retention device include plastic.

13. The apparatus as claimed in claim 11, wherein the receptacle body includes a ledge configured to contact the ridge of each prong and prevent removal of the retention device from the receptacle body.

14. The apparatus as claimed in claim 11, wherein the receptacle body includes a tapered interior wall which contacts the at least one prong of the retention device and forces the at least one prong toward the shroud of the plug.

15. The apparatus as claimed in claim 11, wherein the barb of each prong of the retention device releases the shroud of the plug when said face portion of the retention device is forced toward the receptacle body.

16. The apparatus as claimed in claim 11, wherein each barb extends from each prong at an angle of about 120-150 degrees from the prong as the prong extends from the face portion of the retention device.

17. An apparatus for retaining a connector within an inlet mechanism;

an inlet mechanism, the inlet mechanism including a male electrical fitting; and a retention device, the retention device including a face portion and at least four prongs, each prong of the at least four prongs including a metal barb on a first side of the prong and a ridge on a second side of the prong, wherein the retention device is configured to retain a connector inserted within said inlet mechanism by contact with a shroud of the connector from the barb of each prong of said at least four prongs of the retention device.

18. An apparatus for retaining a plug within a receptacle;

a receptacle body; and a retention device, the retention device including a face portion and at least one prong, each prong of the at least one prong including at least one barb, wherein the retention device is configured to retain a plug within said receptacle body by contact with a shroud of the plug from the at least one barb of each prong of said at least one prong of the retention device, each prong of said at least one prong of the retention device includes a ridge located on an opposite side of the at least one barb, the receptacle body includes a tapered interior wall which contacts the at least one prong of the retention device and forces the at least one prong toward the shroud of the plug.

19. An apparatus for retaining a plug within a receptacle;

a receptacle body; and a retention device, the retention device including a face portion and at least one prong, each prong of the at least one prong including at least one barb, wherein the retention device is configured to retain a plug within said receptacle body by contact with a shroud of the plug from the at least one barb of each prong of said at least one prong of the retention device, the at least one barb of each prong of the retention device is configured to release the shroud of the plug when said face portion of the retention device is forced toward the receptacle body.

20. An apparatus for retaining a plug within a receptacle;

a receptacle body, the receptacle body comprising a receptacle, the receptacle including a female electrical fitting; and a retention device, the retention device including a face portion and at least four prongs, each prong of the at least four prongs including a barb on a first side of the prong and a ridge on a second side of the prong, wherein the retention device is configured to retain a plug inserted within the receptacle body by contact with a shroud of the plug from the barb of each prong of said at least four prongs of the retention device, the receptacle body includes a ledge configured to contact the ridge of each prong and prevent removal of the retention device from the receptacle body.

21. An apparatus for retaining a plug within a receptacle;

a receptacle body, the receptacle body comprising a receptacle, the receptacle including a female electrical fitting; and a retention device, the retention device including a face portion and at least four prongs, each prong of the at least four prongs including a barb on a first side of the prong and a ridge on a second side of the prong, wherein the retention device is configured to retain a plug inserted within the receptacle body by contact with a shroud of the plug from the barb of each prong of said at least four prongs of the retention device, the receptacle body includes a tapered interior wall which contacts the at least one prong of the retention device and forces the at least one prong toward the shroud of the plug.

22. An apparatus for retaining a plug within a receptacle;

a receptacle body, the receptacle body comprising a receptacle, the receptacle including a female electrical fitting; and a retention device, the retention device including a face portion and at least four prongs, each prong of the at least four prongs including a barb on a first side of the prong and a ridge on a second side of the prong, wherein the retention device is configured to retain a plug inserted within the receptacle body by contact with a shroud of the plug from the barb of each prong of said at least four prongs of the retention device, the barb of each prong of the retention device releases the shroud of the plug when said face portion of the retention device is forced toward the receptacle body.

* * * * *